United States Patent [19]

Thompson

[11] Patent Number: 4,602,734

[45] Date of Patent: Jul. 29, 1986

[54] RELEASABLY ENCLOSABLE FILE FOLDER

[76] Inventor: Edward W. Thompson, 3614 W. Rockwell, Spokane, Wash. 99205

[21] Appl. No.: 658,230

[22] Filed: Oct. 5, 1984

[51] Int. Cl.[4] ..... B65D 37/00; B65D 27/28

[52] U.S. Cl. ..... 229/1.5 R; 229/77

[58] Field of Search ..... 229/1.5 R, 72, 77, 78 A; 312/184; 40/359

[56] References Cited

U.S. PATENT DOCUMENTS

| | | | |
|---|---|---|---|
| 460,264 | 9/1891 | Lavette . | |
| 521,760 | 6/1894 | Cramer . | |
| 589,609 | 9/1897 | McConnell | 229/77 |
| 1,048,577 | 12/1912 | Pardoe, Jr. . | |
| 1,722,911 | 7/1929 | Greenhaus | 229/72 |
| 2,726,804 | 12/1955 | Poppe | 229/77 |
| 3,323,708 | 6/1967 | Nesbit | 229/72 |
| 3,552,640 | 1/1971 | Young | 229/DIG. 3 |
| 3,680,969 | 8/1972 | Gorman | 40/359 |
| 4,140,317 | 2/1979 | Ramney . | |
| 4,157,875 | 6/1979 | Smith et al. | 312/184 |
| 4,284,227 | 8/1981 | Corey | 229/DIG. 3 |
| 4,332,400 | 6/1982 | Hayman . | |

FOREIGN PATENT DOCUMENTS

| | | | |
|---|---|---|---|
| 45016 | 12/1931 | Denmark | 229/77 |
| 361257 | 1/1923 | Fed. Rep. of Germany | 229/77 |
| 1566394 | 5/1969 | France | 40/359 |
| 204869 | 9/1939 | Switzerland | 40/359 |

*Primary Examiner*—Stephen P. Garbe

*Attorney, Agent, or Firm*—Keith S. Bergman

[57] ABSTRACT

A rectilinear file folder, formable from a single piece of flat stock, that has flaps to enclose the edges of the folder to maintain loose contents therein. The flaps are releasably maintained in a closed condition by fabric type fasteners.

1 Claim, 4 Drawing Figures

FIG. 2
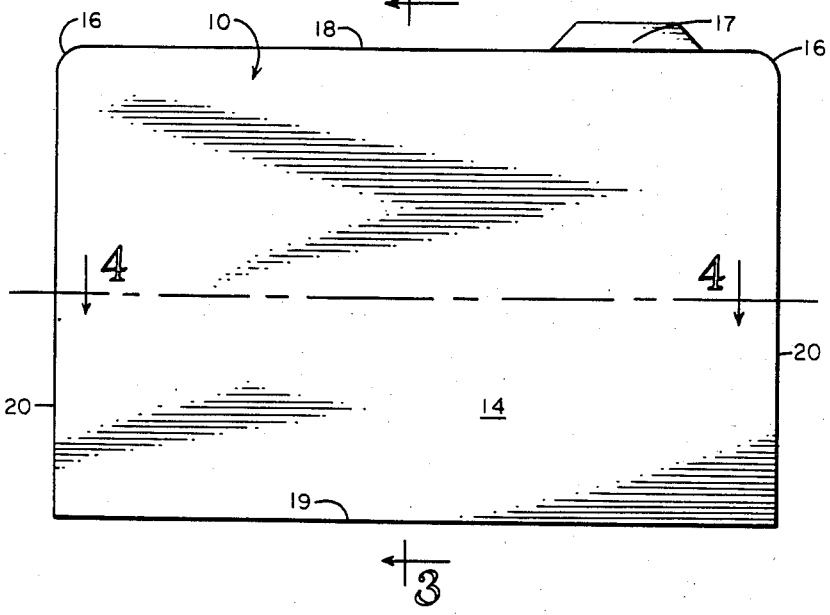
FIG. 3
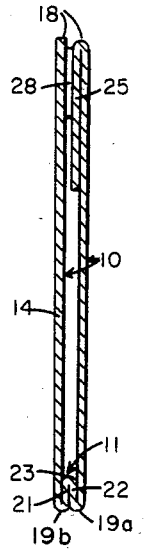
FIG. 4
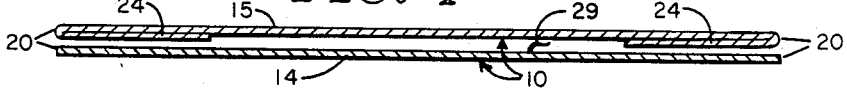
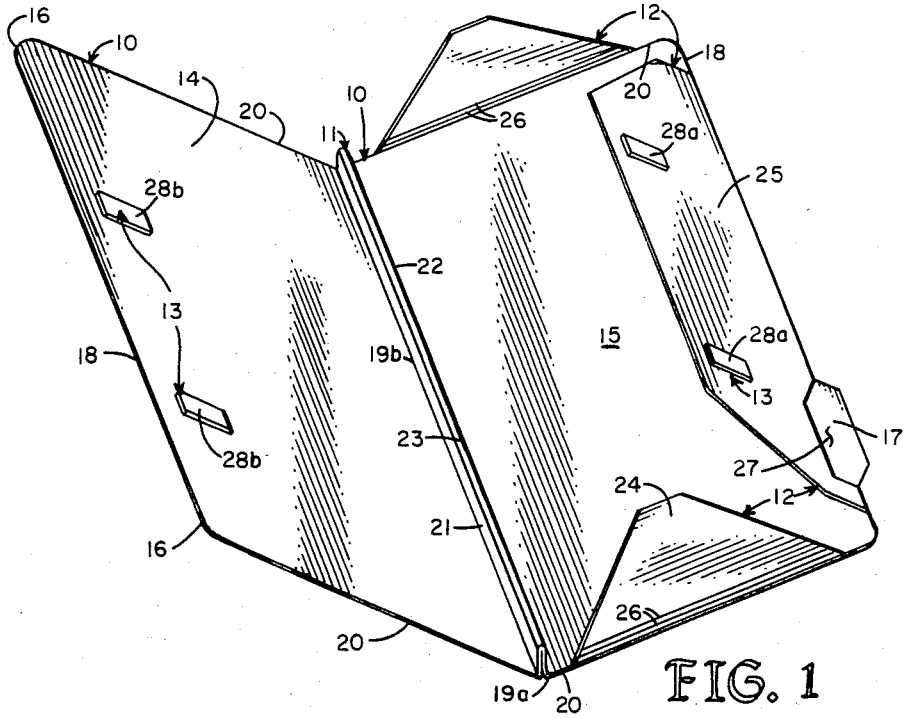
FIG. 1

RELEASABLY ENCLOSABLE FILE FOLDER

BACKGROUND OF INVENTION

FIELD OF INVENTION

My invention relates generally to file folders for sheet paper and more particularly to such folders that are releasably closable about their entire periphery.

DESCRIPTION OF PRIOR ART

Folders for grouping a plurality of sheets of paper, normally in an ordered fashion, are widely used in modern day business to maintain and store the contained group of papers, especially as in some larger container such as a cabinet, file drawer or the like. These file folders serve the purpose not only of ordering and classifying various contained papers but also of maintaining the papers in a peripherally protected group. Commonly file folders day are of rectilinear configuration with dimensioning to accommodate the ordinary sizes of sheet paper in present day use. These file folders are normally formed of flat sheet stock folded upon itself to Ocreate a file with one closed folded side, normally the bottom, and three open sides.

Papers carried in such a file are commonly maintained in a particular ordered fashion by mechanical fasteners. One common fastener is a "U" shaped soft metallic clip that may be inserted through paired spaced holes, both defined in the file and the papers to be carried therein, with legs bent on the side opposite the back to maintain the papers. These clips generally all provide some sort of structure with a portion protruding on a peripheral surface of a file being serviced.

Generally present day file folders are used with some sort of a paper fastening device, as if they be used without such a device papers in a file are loose and free to pass from the file through any open side or a combination of them during handling operations. Often times if this occurs, papers from a file may become disarrayed and unordered or may become associated with other papers all to disrupt the whole purpose of the file folder in the first instance. To alleviate this problem to some degree file folders, more in the form of an envelop with more than one side enclosed, have come into use. Commonly such folders have three sides enclosed with a foldable flap enclosing the fourth side when desired. Normally the three closed sides are fixedly closed and not releasably openable. With this structure, papers in such a file must be removed for viewing and may not be viewed if they are fastened in the file. The flap closing the fourth side of such a file normally folds on the outer file surface where it is readily susceptible to physical damage, and if it be fastenable in a closed mode, the fastening structure or some part of it normally protrudes on or from the peripheral file surface in such fashion that it may catch on external objects or cause damage to such objects or the envelope itself.

The instant invention seeks to provide a file folder that alleviates these problems and yet provide an enclosable folder without any peripherally protruding fastening devices.

My invention provides a rectilinear folder having two similar sides foldable upon each other, with one side defining flaps, at each of its three unconnected edges, which may be folded inwardly to form a closure for contained papers at each of those edges. The folder itself is of the same size, shape and configuration as traditional file folders so that it may be used interchangably with existing file folders and containers and storage facilities therefore. It also provides the traditional tab structure of existing file folders for display of appropriate identifying indicia.

The bottom of my file folder, that is the edge that interconnects the two sides, is folded upon itself to provide a hinged connection with an inwardly extending flap of double thickness to provide greater rigidity and durability for this area of the structure and allow expansion, if desired.

My folder structure is maintained in a releasably closed mode by fabric type fasteners appropriately positioned to accomplish this purpose. I prefer one or more pairs of such fasteners with one element of a cooperating pair positioned between the top flap carried by one side and the other element of the pair carried by the inside of the other folder side. Releasable fasteners of other types may be used with my invention, especially such as releasable adhesives of the rubber cement type, though they tend to collect debris more readily then fabric type fasteners and may not be so effective or have such a long life. The fastening devices may vary in size and number and may be variously positioned otherwise than as set forth to still accomplish their purposes. Heretofore various envelope structures have used releasable fastening elements of one sort or another, but such devices have not generally come into use in the file folder field and especially with file folders of traditional shape that provide functions of the common three open sided file folder of present day commerce.

My invention is further distinguished from the prior file folder art in that it allows papers to be carried within its closure in loose fashion without any necessary mechanical attachment either to other papers, to the file folder, or to both. With my structure, since there is no mechanical connector, there is no part of such a connector that might protrude from a peripheral surface of the file folder where it might catch on other file folders or papers or where it might cause damage to other objects with which it comes into contact, such as other files or desks. It is to be noted however, that though mechanical fasteners are not required, and usually not desirable with my invention, they may be used in the traditional fashion as they are presently used with the common file folder having three open sides.

Notwithstanding the new features of my invention, it is to be noted that file folders embodying the invention are of the same configuration as traditional file folders and may be used in the same containers and in the same fashion as the traditional file folders having three open sides. My folder provides the traditional tab structure and positioning of that structure to allow ordinary placement of the indicia identifying files. My folder may be formed of substantially the same stock as the present day file folders but yet provides a more rigid and durable structure aside from providing its other inventive features.

My invention lies not in any one of these features per se but rather in the particular and unique synergetic combination of all of them as disclosed and specified.

BRIEF DESCRIPTION OF INVENTION

My invention generally provides a file folder having two sides foldable upon each other with one side having flaps about the three unconnected edges to form a complete closure about the periphery of the folder for contained papers.

The connected edges of the two folder sides are folded upon themselves to provide an inwardly extending tab of double thickness at the folder bottom. The three non-connected edges of one side carry flap structures that are foldable inwardly to maintain loose papers within the file enclosure. Cooperating pairs of releasably interconnectable fabric fasteners communicate between flaps and the folder side not defining flaps to maintain the folder in a releasably closed mode. The top of the file defines tab structure to carry identifying indicia. The folder is formed from ordinary kraft paper of the type found in present day file folders.

In providing such a file folder, it is:

A principal object of my invention to create such a device that creates a containment chamber that may that creates a containment chamber that may contain loose papers and prevent their accidental passage out of the file folder.

A further object of my invention to provide such a device that is of the traditional configuration and dimension of present day file folders so that it may be used interchangably with them and with containers for them.

A further object of my invention to provide such a folder that does not require the use of secondary mechanical fastening devises to maintain papers therein and therefore has no parts of any such fastening devices projecting or protruding from its peripheral surfaces where they might damage or interconnect with other objects.

A further object of my invention to provide such a folder that is maintainable in a releasably closed mode by fastening devices so as to be easily manually manipulatable, extremely reliable and durable, and do not cause damage to the folder by reason of manipulation.

A still further object of my invention to provide such a folder that may be formed from a unitary piece of flat foldable material, especially as of kraft paper of the same kind from which present day file folders are formed.

A further object of my invention to provide such a device that is of new and novel design, of rugged and durable nature, of simple and economic manufacture and one that is otherwise well adapted to the uses and purposes for which its intended.

Other and further objects of my invention will appear from the following specifications and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings, which form a part hereof and in which like numbers of reference refer to similar parts throughout:

FIG. 1 is an isometric view of my file folder in open mode showing its various parts, their configuration and relationship.

FIG. 2 is an orthographic side view of the file folder of FIG. 1 shown in closed mode and in vertical position as for filing.

FIG. 3 is a medial vertical cross-sectional view through the file folder of FIG. 2, taken on the line 3—3 thereon in the direction indicated by the arrows.

FIG. 4 is a horizontal cross-sectional view through the file folder of FIG. 2, taken on the line 4—4 thereon in the direction indicated by the arrows.

DESCRIPTION OF THE PREFERRED EMBODIMENT

My invention generally comprises side structure 10 interconnected by bottom flap 11 with the back side carrying peripheral flap structure 12 and both sides releasably interconnect by fastening structure 13.

Side structure 10 comprise front side 14 and back side 15, defined with normal orientation as shown in FIG. 2, each having rounded upper corners 16 to aid durability and minimize damage from contact with external structures. The configuration of my file folder normally is rectilinear and similar to sheets of paper that are to be therein contained, commonly slightly larger then either letter size or legal size paper, so that one of the other of these papers may be contained within the closure defined by the folder. The external peripheral dimensions of my folder are normally the same as those of the letter or legal size files of present commerce that have three open sides.

Backside 15 defines upstanding elongate tab 17, again of shape similar to the tabs of present open-sided files. This tab is shown in a so called "right hand" position in the illustrations, but it obviously may be variously positioned along top edge 18 of the back side 15. This tab ordinarily bears identifying indicia of the file. Commonly when a plurality of files are used or stored in conjunction with each other, the tabs of the files are staggered at different positions to allow more ready access and visibility.

Back flap 11 forms a folded hinge-type structure communicating between lower edges 19*a*, 19*b* of back side 14 and front side 15 of my file. This back flap is formed by folding portion 21 of front side 14 upon portion 22 of back side 15 to form a back flap of double thickness joined at its inner upper edge 23 and extending into the file closure, as illustrated particularly in FIG. 1. Normally, but not necessarily, this back flap will be of the same length as lower edges 19 of sides 10. Preferably the adjacent surfaces of front side portion 21 and back side portion 22 will not be permanently fastened to each other to allow an expansion of the element when necessary, but if desired the surfaces may be releasably interconnected by adhesion or other similar means or can even be permanently interconnected. This back flap tends to aid in maintaining papers in an ordered array within the file and also provides extra strength for the lower portion of the file folder structure. This strength is increased by fastening the adjacent portions of the back flap to each other, but normally the flap is strong enough without doing this, and if the portions be permanently fastened there is no ready means for expansion of the file except by stretching or bowing its elements.

The dimensioning of the back flap may vary over a considerable range and yet remain in the ambit of my invention. Commonly I prefer to have the flap extend a distance of approximately one-half inch away from the lower edges 19 of the two sides it joins, as this is sufficient to allow its use to maintain paper in the file and generally provides more rigidity then if the flap were to have a greater extension.

Back side 15 carries peripheral flap structure 12 with similar truncated triangular side flaps 24 communicating with side edges 20 and doubly truncated trapezoidal top flap 25 communicating with top edge 18. These flaps are commonly formed in a unitary fashion with the remainder of the file and are folded relative to back side 15 at its peripheral edges in the manufacturing process. Each of the flaps is mechanically indented at the periphery of backside 15 and at spaced distances therefrom to allow the flap to be readily folded relative to the back side. The indentation at a distance from the periphery of the back side allow the flap to be folded for expansion of the file folder should the contents thereof become sufficient to require this.

The exact shape and configuration of peripheral flaps 12 is not particularly critical to my invention so long as they fold inwardly upon the inner surface of back side 15. I prefer that the side flaps be truncated triangles and the top flap be a doubly truncated trapezoid similar to the elements illustrated to FIG. 1. The flaps preferable do not extend the full length of the sides to which they are attached, but rather terminate a spaced distance from each end of those sides. This allows the flaps to be more easily folded inwardly and also provides air spaces through which air entrapped in the file enclosure 29, when the file is being closed may escape, to allow simpler and faster closure. This positioning of communication of flaps with back side also provides stress points at other then the corners of the back flap which tends to better distribute stresses between the flaps in the back and in the back itself so that the entire structure is more durable and less susceptible to physical damage.

Tab notch 27 is defined in top flap 25 to allow the formation of tab 17 that extends in coplaner relationship with back side 15. This slot is defined in the formation process, normally by punching, so that a structure as illustrated in FIG. 1 results when the top flap is folded relative to top edge 18 of back side 15.

Fastening structure 13 defines paired cooperating fastening elements 28 so fastened to each other as to be released by simple manual manipulation. In the instance illustrated there are portions 28*a* of two fastening elements positioned in spaced relation on the surface of top flap 25 that faces front side 14 of my folder. Cooperating elements 28*b* of each pair are positioned on the inner surface of front side 14 that faces the top flap so that each paired element might come into contact with the other to form a releasably fastenable communication therewith. The various fastening elements are positionally maintained on my file folder by mechanical fastening, normally as in the instance illustrated by adhesion, though they may be maintained by other similar means.

The particular fastening elements that are preferred are cooperating pairs of fabric fasteners, one element of which comprise a plurality of hooks and the other element of which comprise a plurality of loops that may be releasably attached to the hooks. The fabric-type fastener is most reliable in its operation, may be released by ordinary simple manual manipulation, is most durable and may be quite readily attached to a file folder. This particular type of fastener, though preferred, is not essential to my invention and other similar releasable fastening devices may be used with it, particularly such as releasably bondable rubber cements, various mechanical snaps,magnets, and other similar devices of the present day art.

Though in the instance illustrated there are two cooperating pairs of fasteners that are attached respectively to the top flap facing surface of the front side 14 and side facing surface of the top flap 25, fasteners may be variously positioned elsewhere on the folder and may be increased or decreased in number. Obviously one fastener on these two surfaces or other surface will cause a fastening of the envelope. Fasteners might be placed on the side flaps and possibly between adjacent surfaces of front side 14 and back side 15. The placement of fasteners illustrated, however, has been found to be most efficient, convenient and effective.

Having thusly described the structure of my invention, its operation may be readily understood.

To use my invention, firstly, a file folder is constructed as specified with dimensions appropriate to contain papers to be associated with it, normally either letter or legal size papers.

To use the folder, it is opened by manually moving front side 14 away from top flap 25 to cause the fastening elements on these two elements to release their fastening bond. The file is then manipulated to an open somewhat as that illustrated in FIG. 1. In this condition papers desired to be placed in the folder are placed upon the inner surface of back side 14 and under peripheral flaps 12 and back flap 11. When so positioned, the envelope is closed by moving back and peripheral flaps downwardly upon the papers resting in closure 29 and front side 14 is then moved downwardly thereover so that fastening elements carried thereby come into contact with paired fastener elements carried by top flap 25. Appropriate pressure is applied to the fastening surfaces to cause fastening and the file then is in its normally closed mode. It may generally be dealt with in this mode as any other file and stored in ordinary file containers.

To reuse the file it is merely manually manipulated in reverse fashion to bring the file to its open mode when papers may be inspected, removed or added as desired.

The ordering of papers in my file folder normally will be maintained as originally established, especially so long as the papers involved occupy more then one-half of the area of one of the sides 10 of the folder. If two papers are each less then half of the area of the sides and of appropriate configuration they may occupy the same level in the folder and it is possible that their ordering might be changed by manipulation of the folder. In the course of ordinary manipulation, however, this seldom occurs.

If the folder is to contain a substantial thickness of papers, it is to be noted that this thickness of contents may be accommodated by expanding the back flap and the peripheral flaps to the appropriate thickness of contents. When expanded for thicker contents, the folder will operate in the same fashion as heretofore described, except that the peripheral flaps will be folded inwardly of their communication with back side 15 and the back flap will disappear in its entirety. As this occurs, normally there will be no need for the additional strength of the back flap as the contents of the folder will provide such rigidity and strength for the folder as may be required.

It is to be noted from the foregoing description that my folder will have substantially the same peripheral size, configuration and thickness as a traditional file folder of the present day that has three open sides, and my folder may therefore be stored and dealt with in substantially the same fashion. None of the file handling mechanisms, including ordinary storage cabinets, need be changed or altered for use with my file folders.

It is further to be noted that my folder has no paper fastening devices projecting on the outside of its peripheral surfaces, but rather those peripheral surfaces are smooth and continuous so that they have nothing that can catch on other adjacent files or other objects with which the folder may come into contact, and it does not have any such devices that may scratch desks or other objects on which my folders are used.

It is further to be noted, as illustrated particularly in FIG. 1, that my file folder may be formed to appropriate configuration from a unitary sheet of material and thereafter folded to the appropriate configuration illustrated. The folder may also be formed from the normal kraft paper from which file folders of the present day having three open sides are traditionally formed.

The foregoing description of my invention is necessarily of a detailed nature so that a specific embodiment of it may be set forth as required. It is to be understood, however, that various modifications of detail and rearrangement or multiplication of parts may be resorted to without departing from its spirit, essence or scope.

Having thusly described my invention, what I desire to protect by Letters Patent and what I claim is:

1. An enclosable file folder formed of foldable semi-rigid sheet material comprising, in combination:

a substantially rectilinear front side configured similarly to and slightly larger than material to be contained hterein;

a back side, similarly sized and configured as the front side, foldably interconnected with the front side by adjacent portions of each side being folded upon themselves to form a back flap which is expandable and the back side having opposed side flaps at each of its sides and a top flap at the edge opposite the back flap, each of said flaps being foldably interconnected to the non-connected edges of the back, each said flap defining a plurality of indentations parallel to and at spaced distances from the foldable interconnection of the flap with the back side to aid folding along any of said indentations;

the top flap having a tab severed therefrom, at the foldable connection with the back side, to extend in coplanar orientation with the back side and away therefrom;

at least one first fastening element carried by the front side facing surface of the top flap and at least one cooperating second fastening element carried by the top flap facing side of the front side, each fastening element being positioned to releasably fasten to the other when the file folder is in closed mode.

* * * * *